US011846083B2

(12) United States Patent
Rider et al.

(10) Patent No.: US 11,846,083 B2
(45) Date of Patent: Dec. 19, 2023

(54) LOCKING DEVICE FOR A QUICK COUPLER

(71) Applicant: WEDGELOCK EQUIPMENT LIMITED, Upper Hutt (NZ)

(72) Inventors: Michael Hugh James Rider, Te Horo Beach (NZ); Andrew James Phillip Rider, Te Horo Beach (NZ); David Aperahama Calvert, Lower Hutt (NZ); Matthew James Calvert, Wellington (NZ); Andre Richard Anderson, Featherston (NZ)

(73) Assignee: WEDGELOCK EQUIPMENT LIMITED, Upper Hutt (NZ)

( * ) Notice: Subject to any disclaimer, the term of this patent is extended or adjusted under 35 U.S.C. 154(b) by 460 days.

(21) Appl. No.: 15/782,010

(22) PCT Filed: Dec. 1, 2016

(86) PCT No.: PCT/NZ2016/050189
§ 371 (c)(1),
(2) Date: Jun. 6, 2018

(87) PCT Pub. No.: WO2017/099610
PCT Pub. Date: Jun. 15, 2017

(65) Prior Publication Data

US 2018/0355579 A1 Dec. 13, 2018

(30) Foreign Application Priority Data

Dec. 7, 2015 (NZ) ..... 714945

(51) Int. Cl.
*E02F 3/36* (2006.01)

(52) U.S. Cl.
CPC ..... *E02F 3/364* (2013.01); *E02F 3/3627* (2013.01); *E02F 3/3645* (2013.01); *E02F 3/3663* (2013.01)

(58) Field of Classification Search
CPC ..... E02F 3/364; E02F 3/3627; E02F 3/3645; E02F 3/3663; E02F 3/3604; E02F 3/3609; E02F 3/3618; E02F 3/365
(Continued)

(56) References Cited

U.S. PATENT DOCUMENTS 3,065,977 A * 11/1962 Richardson ..... E02F 3/3618 280/474
3,531,140 A * 9/1970 Fadden ..... A01B 59/062 172/275
(Continued)

FOREIGN PATENT DOCUMENTS

AU 2009220315 A1 9/2009
CN 101550706 A 10/2009
(Continued)

OTHER PUBLICATIONS

International Search Report and Written Opinion received for PCT Patent Application No. PCT/NZ2016/050189, dated Feb. 20, 2017, 17 pages.
(Continued)

*Primary Examiner* — Edwin J Toledo-Duran
(74) *Attorney, Agent, or Firm* — WOMBLE BOND DICKINSON (US) LLP

(57) ABSTRACT

A wedge locking element (10) for a locking device of a quick coupler A for coupling the pin P2 of an attachment to earth working machinery. The wedge locking element (10) has a sloping wedge surface (13). Projecting from the wedge surface (13) is an engagement surface (12) with which the attachment pin P2 can engage but not apply any substantial
(Continued)

driving force to the wedge locking element (10) in the event of failure of a force maintaining the wedge locking element (10) in a position where the pin P2 is retained with the coupler A. The pin engagement surface (12) lies in a plane that is substantially in line with the direction in which the locking element (10) is, in use, moved by the driving force.

10 Claims, 5 Drawing Sheets

(58) Field of Classification Search
USPC ..... 37/468, 403, 234, 413, 723; 414/723
See application file for complete search history.

(56) References Cited

U.S. PATENT DOCUMENTS 4,480,955 A * 11/1984 Andrews ..... E02F 3/364 37/468
5,107,610 A * 4/1992 Fusco ..... E02F 3/3627 37/444
5,147,173 A * 9/1992 Fauber ..... E02F 3/364 403/325
5,179,794 A * 1/1993 Ballinger ..... E02F 3/3663 37/468
6,233,852 B1 * 5/2001 Pemberton ..... E02F 3/3668 37/468
6,625,909 B1 * 9/2003 Miller ..... E02F 3/3622 37/468
6,691,438 B2 * 2/2004 Fatemi ..... E02F 3/3627 37/468
6,699,001 B2 * 3/2004 Fatemi ..... E02F 3/365 37/468
6,964,122 B2 * 11/2005 Cunningham ..... E02F 3/3663 37/468
7,086,821 B1 * 8/2006 Reicks ..... E02F 3/3627 37/468
7,426,796 B2 * 9/2008 Cunningham ..... E02F 3/3618 37/234
7,654,019 B2 2/2010 Yeager et al.
7,866,935 B1 * 1/2011 Wilt ..... E02F 3/3622 403/321
8,262,310 B2 * 9/2012 Sikorski ..... E02F 3/3618 37/468
8,585,345 B2 * 11/2013 Sikorski ..... E02F 3/3663 414/723
8,622,645 B2 1/2014 Hill
8,662,817 B2 * 3/2014 Daraie ..... E02F 3/3618 37/468
8,678,697 B2 * 3/2014 Monaghan ..... E02F 3/3663 37/468
8,684,623 B2 * 4/2014 Robl ..... E02F 3/3627 37/468
8,782,931 B2 * 7/2014 Balemi ..... E02F 3/3663 37/468
8,869,437 B2 * 10/2014 Robl ..... E02F 3/3618 37/468
9,217,235 B2 * 12/2015 Robl ..... E02F 9/2296
9,469,965 B2 * 10/2016 Hill ..... E02F 3/3663
10,975,544 B1 * 4/2021 Clemons ..... E02F 3/3622
11,421,394 B2 * 8/2022 Jo ..... E02F 9/24
2002/0064446 A1 * 5/2002 Dvorak ..... E02F 3/3627 414/723
2002/0071754 A1 * 6/2002 Fatemi ..... E02F 3/3618 414/723
2002/0157286 A1 * 10/2002 Fatemi ..... E02F 3/3663 37/403
2007/0245603 A1 * 10/2007 Vering ..... E02F 3/3663 37/468
2010/0124453 A1 * 5/2010 Sikorski ..... E02F 3/3627 403/42
2010/0192425 A1 * 8/2010 Miller ..... E02F 3/3618 37/468
2010/0232920 A1 * 9/2010 Calvert ..... E02F 3/3663 414/723
2010/0247228 A1 9/2010 Monaghan et al.
2011/0091267 A1 * 4/2011 Hill ..... E02F 3/365 91/462
2012/0189380 A1 7/2012 Doherty et al.
2012/0266432 A1 10/2012 Balemi
2013/0164080 A1 * 6/2013 Miller ..... E02F 3/3663 403/373
2013/0318841 A1 12/2013 Robl et al.
2013/0322954 A1 * 12/2013 Robl ..... E02F 3/3622 403/321
2013/0322959 A1 * 12/2013 Robl ..... E02F 3/3627 403/326
2014/0212210 A1 * 7/2014 Robl ..... E02F 3/3636 403/345
2014/0294497 A1 * 10/2014 Robl ..... E02F 3/365 403/376
2014/0308061 A1 * 10/2014 Robl ..... G01N 3/20 73/849
2015/0240456 A1 * 8/2015 Jonsson ..... E02F 3/3627 701/50
2015/0322646 A1 * 11/2015 Anderson ..... E02F 3/3622 403/322.1
2016/0237656 A1 * 8/2016 Doherty ..... E02F 3/3618
2018/0066418 A1 * 3/2018 Keighley ..... E02F 3/3663
2018/0148903 A1 * 5/2018 Hart ..... E02F 3/3627
2018/0238015 A1 * 8/2018 Fey ..... E02F 9/265
2019/0284779 A1 * 9/2019 Maruyama ..... E02F 3/30
2020/0190765 A1 * 6/2020 Clemons ..... E02F 3/3622
2020/0325648 A1 * 10/2020 Nishi ..... E02F 3/3627
2021/0238824 A1 * 8/2021 Anderson ..... E02F 3/3659
2022/0034061 A1 * 2/2022 Walthers ..... E02F 3/364

FOREIGN PATENT DOCUMENTS

CN 102667005 A 9/2012
CN 104981571 A 10/2015
DE 202013004797 U1 8/2014
EP 0674053 A2 9/1995
EP 1445385 8/2004
JP 2001-303608 A 10/2001
JP 2004-124382 A 4/2004
WO 2002/097201 A1 12/2002
WO 2006/083172 A1 8/2006
WO 2009/110808 A1 9/2009
WO 2011/035883 A1 3/2011
WO 2014/137031 A1 9/2014
WO 2015/030282 A1 3/2015
WO 2016/153360 A1 9/2016
WO 2019/026031 A1 2/2019

OTHER PUBLICATIONS

International Preliminary Report on Patentability received for PCT Patent Application No. PCT/NZ2016/050189, dated Jun. 21, 2018, 13 pages.
Written Opinion received for PCT Patent Application No. PCT/IB2021/050685, dated Apr. 6, 2021, 5 pages.
International Search Report received for PCT Patent Application No. PCT/IB2021/050685, dated Apr. 6, 2021, 5 pages.
Office Action received for Australian Patent Application No. 2016365527, dated May 26, 2021, 3 pages.
Office Action received for Chinese Patent Application No. 201680071542.5, dated May 19, 2020, 11 pages (5 pages of English Translation and 6 pages of Office Action).
Office Action received for GB Patent Application No. 1810260.8, dated Jul. 19, 2018, 2 pages.
Office Action received for Japanese Patent Application No. 2018-529159, dated Sep. 23, 2020, 11 pages (5 pages of English Translation and 6 pages of Office Action).

(56) References Cited

OTHER PUBLICATIONS

"Search report and office action," dated Oct. 18, 2021, Russian Application No. 2020108325, 20 pages (8 pages of English translation and 12 pages of original document).

* cited by examiner

LOCKING DEVICE FOR A QUICK COUPLER

BACKGROUND TO THE INVENTION

This invention relates to a locking device for a quick coupler.

Quick couplers for mounting an attachment, e.g. a bucket, to an earth working machine, such as an excavator, are known. A potential danger with a quick coupler is that the coupler can fail to hold the attachment at one or both of the mounting points at which the attachment is mounted to the quick coupler. As a result the attachment can either fall off the coupler (if the coupling at each of the mounting points fails) or swing down from the coupler (i.e. swing about one of the mounting points). The mounting points on the attachment are typically formed by so called pins and these fit into recesses of docking points of the quick coupler and then locked therein.

When the coupler is mounted to the earth working machine such as an excavator, the end that is closest to the operator is referred to herein as the "front end". As a consequence the pin of the attachment that fits into the recess/docking point at the front end is referred to herein as the "front pin". Likewise the other end of the coupler is referred to as the "rear end" and the pin of the attachment that fits therein is referred to as the "rear pin".

The failure to correctly hold the attachment in place can be due to a variety of reasons. For example, if the quick coupler is of a type where the rear pin is retained by a sliding wedge component which is hydraulically operated an hydraulic failure can result in the quick coupler failing to retain the attachment in a working position. This will typically result from the rear pin applying a loading on the sloping leading surface of the wedge component which will drive the wedge "backward" to a position where the pin is no longer locked in the quick coupler. Consequently the attachment will swing down from the coupler about the axis of the front pin.

If the front pin is not retained by a locking device the attachment can fall completely from the coupler. In our New Zealand patent specification No. 552294 there is disclosed a safety locking device that retains the front pin in the coupler in the event of a failure which results in the release of the rear pin. As a result the attachment will only swing down from the coupler about the axis of the front pin.

SUMMARY OF THE INVENTION

An object of the present invention is thus to provide a wedge locking element for a locking device of a quick coupler, the wedge locking element being such that it at least reduces the tendency of a pin retained by the wedge driving the wedge (in the event of hydraulic failure) to a position where the pin will no longer be retained by the coupler or to at least provide the public with a useful choice.

The inventive concept which achieves this object broadly resides in the leading end of the wedge having an orientation relative to a pin with which the wedge will engage in a locking relationship being such that the possibility of the pin applying a loading on the wedge to drive the wedge to a release position is at least reduced.

Broadly according to one aspect of the invention there is provided a wedge locking element for a locking device of a quick coupler for coupling the pin of an attachment to earth working machinery, the wedge locking element including a sloping wedge surface, characterised in that projecting from the wedge surface is an engagement surface with which the attachment pin can engage but not apply any substantial driving force to the wedge locking element in the event of failure of a force maintaining the wedge locking element in a position whereby the pin is wedge coupled by the wedge surface to the coupler.

Broadly in a second aspect of the invention the locking device further includes a clamp device operable to retain the pin with the pin engagement surface in the event of said failure of the driving force.

In a preferred form of the invention the pin engagement surface is located at and forms the distal leading part of the wedge.

In a preferred form of the invention the pin engagement surface is substantially planar.

In a preferred form the pin engagement surface lies in a plane that is substantially in line with the direction in which the locking element is, in use, moved by the driving force.

In a preferred form the driving force is hydraulic.

Preferably the wedge locking element is adapted to couple to an hydraulic linear actuator, and more preferably the wedge locking element forms part of the hydraulic actuator.

In a preferred form of the invention the clamp device is mounted to the wedge locking element.

Preferably in one form of the invention the clamp device includes an arm mounted to be pivotable about a pivot axis, the arm incorporating a pin engagement portion distal from the pivot axis.

In the preferred form of the invention the arm is biased by biasing means. In a preferred form of the invention the biasing means is a spring.

According to a third broad aspect of the invention there is provided a quick coupler for coupling the pin of an attachment to earth working machinery, the coupler including a the combination of the wedge locking element and a clamp device as stated in the above second broad aspect of the invention.

Preferably the wedge locking element is slidingly retained in the quick coupler and the clamp device is mounted for movement with the wedge locking element.

BRIEF DESCRIPTION OF THE DRAWINGS

In the following more detailed description of one embodiment of the invention and its application to a quick coupler reference will be made to the drawings which form part of this specification and in which.

DESCRIPTION OF PREFERRED EMBODIMENTS OF THE INVENTION

The aspects of the present invention will be described herein in relation to one form of quick coupler but it will be appreciated by the skilled addressee that other forms of quick coupler can be used.

Figure 1:
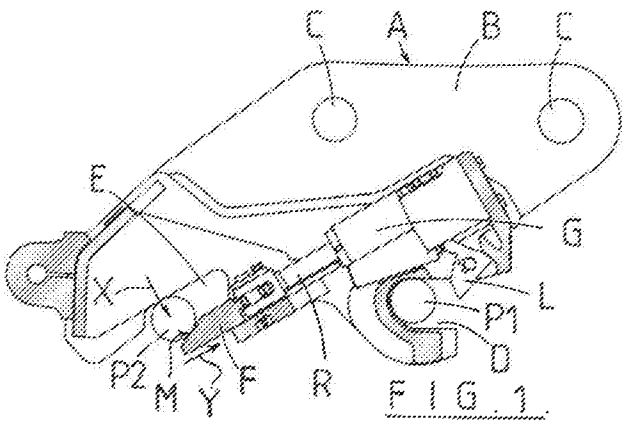
FIG. 1 is a sectioned side elevation view of a prior art hydraulic quick coupler with a wedge form of pin engagement means, the drawing showing the front and rear pins of an attachment engaged in the front and rear recesses of the coupler.
Figure 2:
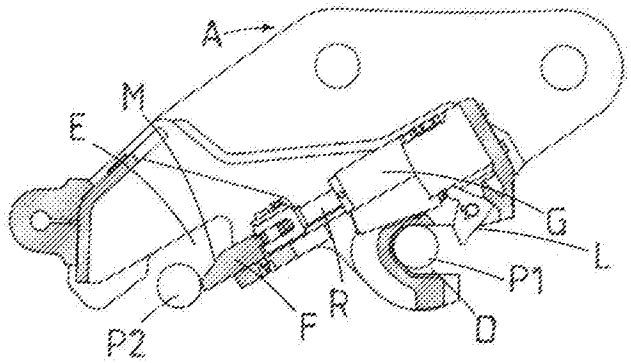
FIG. 2 is a further side elevation view similar to FIG. 1 of the prior art coupler but showing the coupler in a "failed mode" in which the rear pin is able to move out of the rear recess.

The quick coupler as shown in FIGS. 1 and 2 of the drawings is a known form of quick coupler A made by our company. The quick coupler A is operated hydraulically by the hydraulics of the machine (usually an earth working machine) to which the coupler is attached. The body B of the coupler has mounting points C whereby the coupler can be attached to say the arm of an excavator (not shown).

The coupler body B has a hook shaped front recess D into which the front mounting pin P1 of an attachment engages. As mentioned above the hook shaped recess end of the quick coupler is typically referred to as the "front" of the coupler as this is the end of the coupler that will face toward the operator of the machine (e.g. excavator).

The rear mounting pin P2 of the attachment locates in the rear recess E.

The movable locking element F, which in this form of coupler is a wedge component, (hereinafter for simplicity "wedge F") is extendible to capture the rear mounting pin P2 of the attachment in the rear recess E. The wedge F is hydraulically powered.

Thus typically the excavator operator will position recess D of the coupler onto the front pin P1 of the attachment and then crowd the coupler such that the rear pin P2 engages in the recess E. The wedge F is then extended to engage with and lock the rear pin P2 in the rear recess E. The pins P1 and P2 engaged by the coupler A are shown in FIG. 1. The attachment is thereby coupled to the coupler A in the working position.

If, for example, the hydraulic power to the coupler A fails the hydraulic cylinder G that moves and holds the wedge F in its locking position will not be able to hold the wedge in the locking position. As a result the wedge F can retract which will enable release of the mounting pin P2 from the recess E to occur (see FIG. 2).

If the front pin P1 in the hook shaped recess or docking part D is not retained in the front recess the attachment can fall from the coupler and hence fall from the excavator arm. However, if the front pin P1 is retained (by say our I-Lock device L as described and claimed in our New Zealand patent specification 552294/546893) then the attachment will not fall completely off the coupler A but will swing down on the pin P1.

In the form of coupler A shown in the drawings the wedge F is part of an operating means formed by hydraulic cylinder G which applies a driving force to control the extension and retraction of the wedge F via the piston rod R of the cylinder G. This is only one example of the form that the cylinder G and wedge F arrangement may take.

As shown in FIGS. 1 and 2 the leading or distal end of the wedge F includes an inclined or sloping surface M. In the event of compound hydraulic failure working forces will cause the pin P2 to drive the wedge F backward (as indicated by arrow Y in FIG. 1). This is due to the sloped face M (and the applied normal forces indicated by the arrow X in FIG. 1). Consequently, the rear pin P2 moves down the wedge face M to a point where it is no longer retained in the rear recess by the wedge F (FIG. 2) and the attachment will be free to swing about the front pin P1 as described above.

For a given attachment the distance between pins P1 and P2 is rigidly fixed, as is the diameter of the pins. In the embodiment shown and described herein the quick coupler caters to attachments which have pin diameters and pin centres which fall within the range provided by the rear recess E, relative to the front recess D. The wedge locking element of the invention thus suits multiple attachment pin centres, but could equally be applied to a single pin centre design.

According to the present invention we have devised a wedge 10 (an example of which is shown in FIGS. 12 to 15) that includes at the leading end a projecting part 11 that provides a substantially flat (planar) pin engagement surface 12. This flat surface 12 extends beyond the lower extremity of the sloping wedge surface 13. The angle between the sloping surface 13 and the flat surface 12 is obtuse.

The configuration of the example of wedge shown in FIGS. 12 to 15 is one which is specific to the type of coupler shown in FIGS. 1 and 2. It will be appreciated by those skilled in the art that a flat projecting pin engagement surface 12 at the leading end of the wedge (as provided by the present invention) could be incorporated with other types and configurations of wedges having a sloping pin engagement surface.

The surface of the pin engagement surface 12 is substantially normal to the direction of forces (indicated by arrow "X") that will be applied by the pin P2 to the wedge 10 in a failed state of the coupler. Thus when the pin P2 reaches the end of the sloped wedge section 13 it is no longer possible to apply a loading on the wedge 10 in the same manner as is applied when the pin P2 is engaged with the sloped face 13. In other words there will be no load which would drive the wedge backward in the direction of arrow "Y".

It will be appreciated that the plane in which pin engagement surface 12 lies is substantially in line with the direction in which the wedge locking element moves back and forth.

Once the rear pin P2 reaches the pin engagement surface 12 of the wedge 10, it may still be possible to apply load to the wedge 10 due to friction between the pin P2 and the pin engagement surface 12. This frictional contact can cause the wedge 10 to move backward (in direction Y) in small cyclic amounts to the point where the pin P2 can pass the extreme edge 21 of the wedge. Thus pin P2 will be able to move away from the recess to be free of the coupler such that the attachment will release from the coupler allowing the attachment to swing on pin P1.

Addition of a means of substantially retaining the relationship between the rear pin P2 and the wedge 10 is thus advantageous and the drawings illustrate such a means in the form of a clamp device 14. The presence of the clamp device 14 will ensure that after the wedge 10 has moved back by the above mentioned amount it is then pulled back again as the pin P2 moves in a direction opposite to direction Y. This clamp device 14 will thus prevent the pin P2 from passing beyond the distal end 21 of the pin engagement surface 12 of the wedge 10 and become disengaged with the coupler.

According to the present invention the clamp device 14 does not require additional hydraulic actuators to operate the clamp device. This not only reduces costs but improves reliability.

The clamp device 14 is coupled to the wedge 10 via a suitable mount 15 so as to be moveable with the wedge 10. The coupling of the clamp 14 to the wedge 10 thereby ensures that the clamp 14 may retain the appropriate relationship with the pin P2 in any wedging position of the wedge 10 with pin P2.

In the illustrated form of the clamp 14 the clamp includes a solid clamp arm 16. In the illustrated and preferred form the clamp arm 16 is substantially in the shape of an arc and is pivotally coupled at one end at 17 to the mount 15.

The clamp arm 16 is biased, preferably sprung biased, and thus in one form the clamp arm 16 is biased by a compression spring 18 (as shown) or other biasing means such as a torsional spring. As illustrated the spring 18 is engaged with the clamp arm 16 at a point spaced from but adjacent to the axis of pivot 17. The other end of the spring 18 is coupled to a cross piece 19 of the mount 15.

The mount 15 is, as described above, carried by the wedge 10. In the illustrated form the mount 15 is located in a suitably shaped recess 1 5*a* provided in the wedge 10.

The clamp arm 16 is of a design and configuration such that the pin P2 can force the clamp arm 16 to move against the bias effect of spring 18 during movement of the pin P2 into the recess E. This provides the necessary clearance to enable the pin P2 to move into the recess.

Thus, for example, the leading and pin contacting portion 20 of the clamp arm 16 is suitably profiled so that it smoothly and positively engages with and rides over the pin P2 during both the engagement of the pin P2 into recess E (when the coupler A is engaging with the attachment) and disengagement from the coupler (when the attachment is being released from the coupler A).

Figure 3:
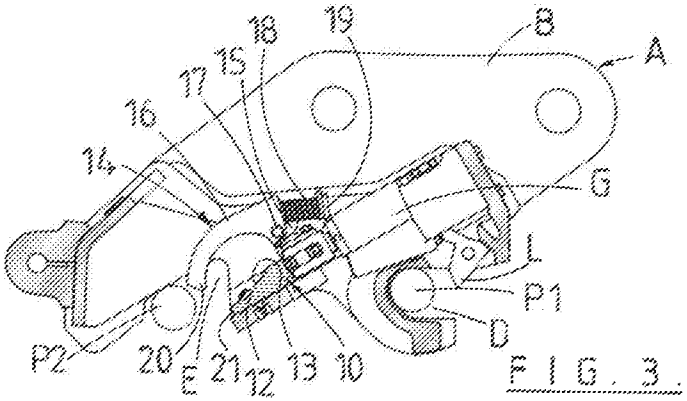
FIG. 3 is a sectioned side elevation view of a coupler with which front and rear pins of an attachment are engaged and in which the leading part of the movable element (for locking the rear pin in the rear recess) has a profile according to the present invention, the movable element being shown in the fully retracted position.
Figure 4:
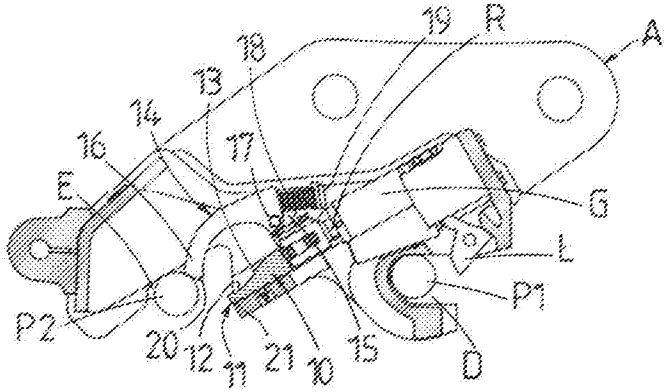
FIGS. 4 to 8 are a succession of sectioned side elevation views of the coupler shown in FIG. 3 showing the rear pin in the rear recess and the progression of the movable element moving into the rear recess until it reaches a fully engaged position where the rear pin is retained in the rear recess by the movable element (FIG. 8)
Figure 5:
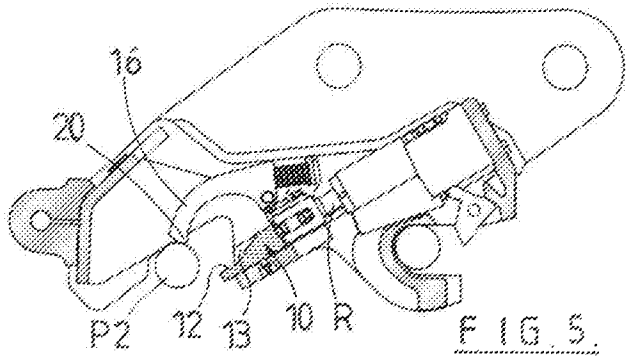
Figure 6:
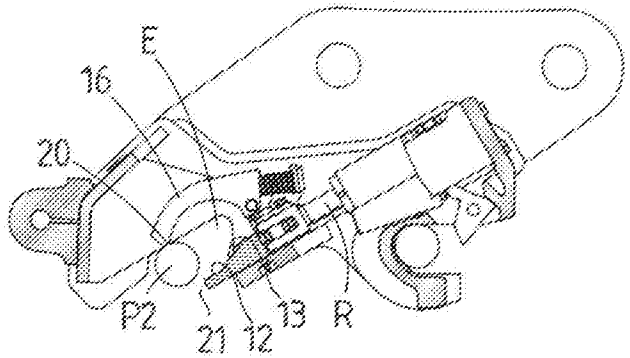

FIG. 3 of the drawings shows the profiled end 20 of the clamp arm 16 approaching the pin P2 as the wedge 10 starts to extend under the action of the cylinder G while FIG. 4 shows end 20 of the clamp arm 16 having come into contact with the pin P2 as the wedge 10 continues to extend. Further advancement of the wedge 10 causes the end 20 of the clamp arm 16 to ride over the pin P2 (see FIGS. 5 and 6).

Figure 7:
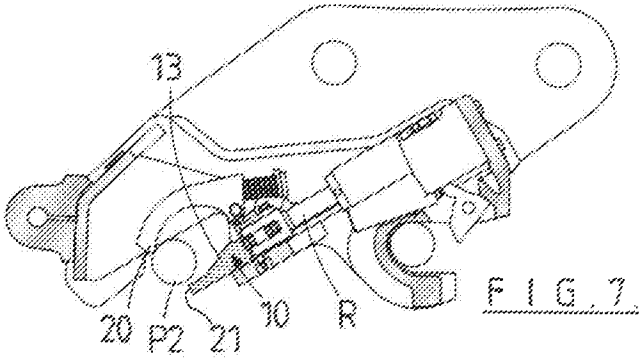

As the wedge 10 continues to advance (FIG. 7) the spring bias on clamp arm 16 causes the end 20 the ride down over the opposite side of the pin P2. Ultimately, with the wedge 10 extended as far as it can go because of the rear pin P2 being fully engaged between the wedge 10 and the opposing surface of the recess E the clamp arm 16 will lie over the pin P2 and in contact with the pin (FIG. 8).

The force available from the hydraulic cylinder G is very large in comparison to the clamp force of the clamp arm 16 provided by the biasing means (e.g. spring 18). Hence the movement of the wedge 10 will result in the clamp arm 16 easily moving against the bias of the spring 18 when engaging and disengaging with the pin P2 during normal function. Thus no additional hydraulic actuators are required to drive or operate the clamp device 14.

Figure 8:
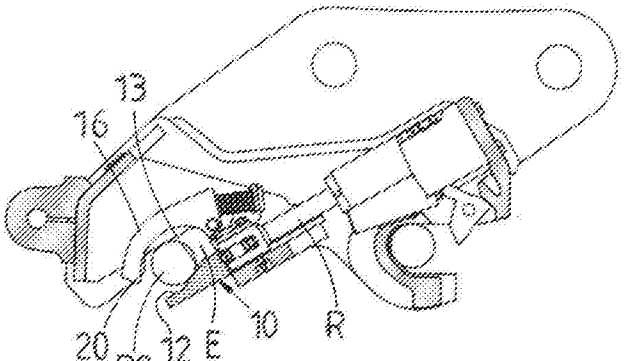

FIG. 8 of the drawings shows the coupler A in the engaged position with pins P1 and P2 and hence the attachment locked onto the coupler. In this position the pin P2 is in the rear recess E and the wedge 10 is extended by cylinder G so that the pin P2 is held between the wedge 10 (in this case sloping surface 13) and the surface of the recess E.

In the case of a larger diameter pin P2 (see FIG. 16) the drawing appears to show pin P2 engaged on both the sloping surface 13 and the pin engagement surface 12 but in reality there is actually a small clearance. Because of this clearance there is substantially no contact between the pin engagement surface 12 and surface of the recess E at the same time thereby avoiding wear which would occur at every engagement/disengagement.

Figure 9:
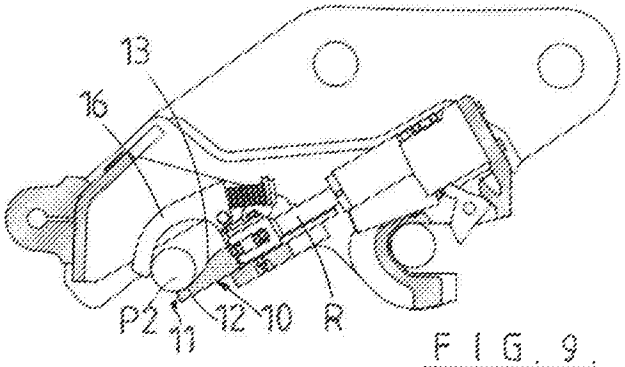
FIG. 9 is a view similar to FIG. 8 but showing the coupler in a failed mode where the movable element has moved into a partially retracted position yet with the rear pin retained in engagement with the movable element by the clamp arm according to the present invention.
Figure 10:
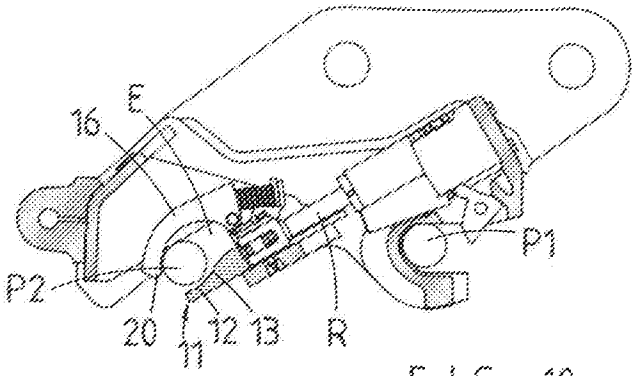
FIG. 10 is a view similar to FIG. 9 but showing the coupler in a failed mode where the movable element has moved into a partially retracted position yet with the rear pin retained not in engagement with the movable element yet still prevented by the clamp arm from moving from the recess.

However, if the wedge 10 retracts (e.g. due to absence of hydraulic pressure) to the point that the pin P2 could become disengaged (see FIG. 9 or 10) the presence of the clamp arm 16 substantially retains the relationship between the pin P2 and wedge 10 thereby resulting in the pin P2 automatically being retained in engagement with the wedge 10. Consequently in a failed mode of the coupler the rear pin P2 will be retained against movement out of the rear recess E.

Figure 11:
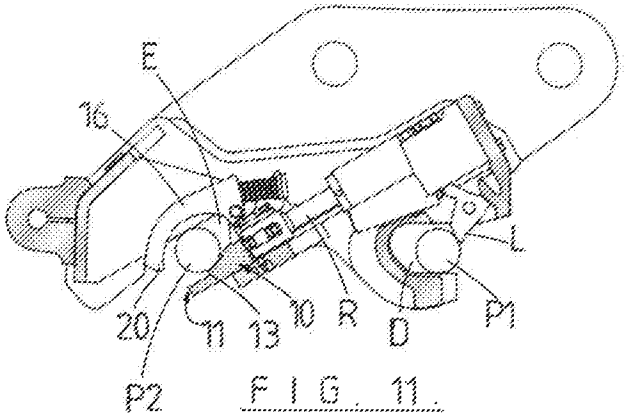
FIG. 11 is a view similar to FIGS. 9 and 10 showing the coupler in a failed mode where the movable element has moved into a partially retracted position yet with the rear pin prevented from moving out of the rear recess by the clamp arm and the front pin prevented from moving from the front recess by the front recess retaining element.
Figure 12:
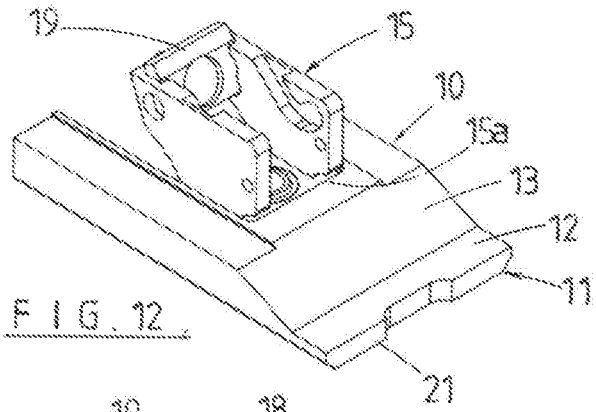
FIG. 12 is an isometric view of an example of the movable element according to the invention with a mount on which the clamp arm is located.
Figure 13:
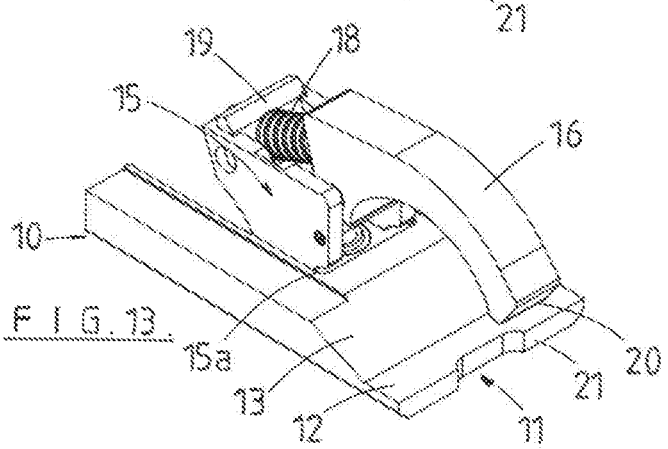
FIG. 13 is a further isometric view of the movable element as shown in FIG. 12 but with the clamp arm coupled to the mount.
Figure 14:
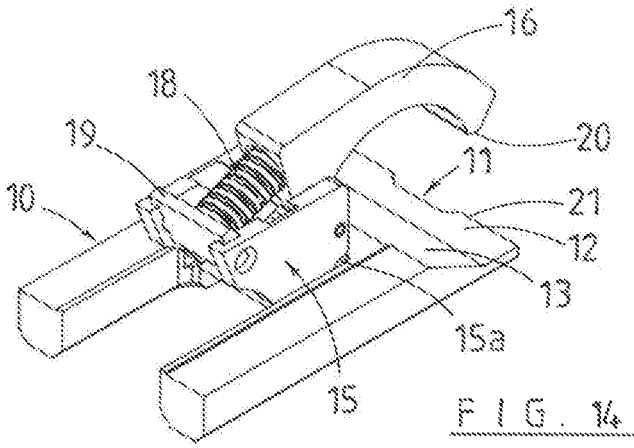
FIG. 14 is a further isometric view of the movable element as shown in of FIG. 13.
Figure 15:
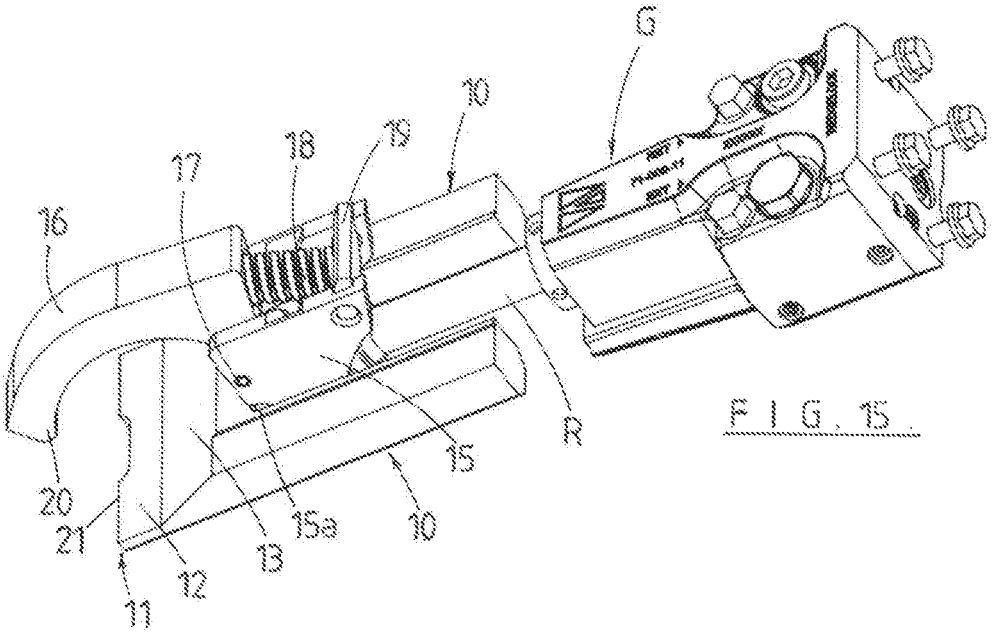
FIG. 15 is an isometric view of the movable element as shown in FIGS. 14 and 15 coupled to an hydraulic cylinder.

The retention of the attachment pins P1 and P2 relies on the front pin P1 being retained by a retention means such as our I-Lock safety locking device mentioned previously. In other words the front pin P1 can only move between its normal position and the locking feature (i.e. the I-Lock) as illustrated in FIG. 11. As a result due to the fixed distance between the front and rear pins P1 and P2 of any one attachment the rear pin P2 may only move by the same amount as the front pin P1.

Figure 16:
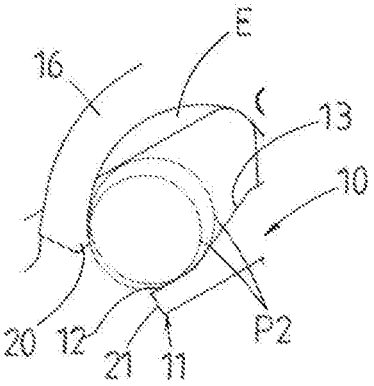
FIG. 16 is a graphical illustration of two different diameter pins retained with the wedge by the clamp arm mechanism.
Figure 17:
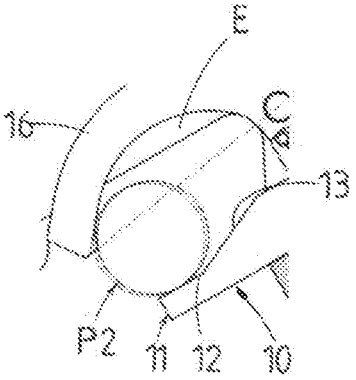
FIG. 17 is a view similar to FIG. 16 illustrating where the smaller sized rear pin would sit if it where not for the shaped end of the clamp arm.

The skilled addressee will appreciate from the foregoing and the drawings that the coupler and in particular the rear end locking mechanism is able to work with pins of different diameters. FIG. 16 of the drawings provides an illustration of two different pin diameters e.g. small and large diameter pins. FIG. 17 of the drawings illustrates where the smaller pin P2 would sit if not for the shaped end 20 of the clamp arm 16.

To this end the shape and configuration of the inside surface of the distal end of the clamp arm 16 is, preferably, shaped so that it will retain the smaller diameter pin as far as possible from the distal end 21 of the flat section 12. This is shown graphically in FIGS. 16 and 17 where the large and small diameters of pin P2 are shown and the smaller diameter pin is shown to be retained closer to the distal edge 21. The smaller pin P2 thus must move further, which in-turn causes the load applied by the clamp device 14 to be higher (i.e. more spring compression).

In the foregoing description the arm 16 is referred to as a clamp arm 16. However, the form and function of the arm 16 is, as will be appreciated by the skilled addressee, such that the arm 16 can be described as a "safety" arm.

The invention is open to modification. For example, the sprung clamp arm 16 can be formed by a spring member.

The present invention has been described and illustrated by way of a specific embodiment, and the embodiment has been described in detail in relation to a known type of quick coupler. It is not the intention of the Applicant to restrict or in any way limit the scope of the invention to such detail.

Additional advantages and modifications will be readily apparent to those skilled in the art. Therefore, the invention in its broader aspects is not limited to the specific details, representative means of manufacture and method, and illustrative examples shown and described. Accordingly, departures may be made from such details without departure from the spirit or scope of the Applicant's general inventive concept.

The invention claimed is:

1. A quick coupler for coupling the pin of an attachment to earth working machinery, the coupler comprising a locking device comprising, a wedge locking element slidingly retained in the quick coupler and configured to move in a linear direction for coupling the pin of an attachment to said earth working machinery, the wedge locking element including a sloping wedge surface, wherein projecting from the wedge surface is a pin engagement surface located at and forming a distal leading part of the wedge locking element, wherein the pin engagement surface is substantially planar and lies in a plane that is substantially in line with the linear direction in which the wedge locking element and pin engagement surface are, in use, moved by a driving force, the pin engagement surface remaining in substantial alignment with said linear direction during movement of the wedge locking element, wherein the attachment pin which engages with said pin engagement surface does not apply any substantial loading to the wedge locking element in the event of failure of the driving force maintaining the wedge locking element in a position whereby the pin is wedge coupled by the wedge surface to the coupler, and a clamp device operable to retain the pin with the pin engagement surface in the event of said failure of the driving force, the clamp device configured in the shape of an arc and the clamp device is mounted to the wedge locking element via a mount for movement therewith, the clamp device pivotable about a pivot axis, and wherein the clamp arm is spring biased by a compression spring and the spring is engaged with the clamp arm at a point spaced from and adjacent to the pivot axis, and wherein the mount is located in a recess provided by the wedge.

2. The quick coupler as claimed in claim 1 wherein the wedge locking element is adapted to couple to an hydraulic linear actuator.

3. The quick coupler as claimed in claim 2, wherein the wedge locking element forms part of the hydraulic linear actuator.

4. The quick coupler as claimed in claim 1 wherein the clamp device includes an arm mounted to be pivotable about a pivot axis, the arm incorporating a pin engagement portion distal from the pivot axis.

5. The quick coupler as claimed in claim 4 wherein the arm is biased by biasing means.

6. The quick coupler as claimed in claim 5 wherein the biasing means is a spring.

7. The quick coupler as claimed in claim 5 wherein the driving force is hydraulic.

8. The quick coupler as claimed in claim 6, wherein the clamp device is configured to, in the event of said failure of the driving force, prevent the pin from passing beyond the distal leading part of the wedge locking element.

9. The quick coupler of claim 8, wherein the driving force of said wedge locking element is configured to be substantially greater than a clamp force of the biasing means of the arm of said clamp device.

10. The quick coupler of claim 9, wherein the driving force of said wedge locking element is configured to be substantially greater than the clamp force of the biasing means of the arm of said clamp device such that movement of the wedge locking element along the linear direction by said driving force results in the arm of said clamp device moving against said biasing force of the biasing means thereof.

* * * * *